US006047784A

United States Patent [19]

Dorel

[11] Patent Number: 6,047,784

[45] Date of Patent: Apr. 11, 2000

[54] APPARATUS AND METHOD FOR DIRECTIONAL DRILLING USING COILED TUBING

[75] Inventor: Alain P. Dorel, Houston, Tex.

[73] Assignee: Schlumberger Technology Corporation, Sugar Land, Tex.

[21] Appl. No.: 08/783,711

[22] Filed: Jan. 16, 1997

Related U.S. Application Data

[60] Provisional application No. 60/011,268, Feb. 7, 1996.

[51] Int. Cl.[7] ..... E21B 7/04

[52] U.S. Cl. ..... 175/61; 175/73

[58] Field of Search ..... 175/73, 74, 61

[56] References Cited

U.S. PATENT DOCUMENTS

| | | | |
|---|---|---|---|
| 3,455,401 | 7/1969 | Taylor . | |
| 3,661,205 | 5/1972 | Belorgey | 166/65.1 |
| 3,669,199 | 6/1972 | Cullen et al. | 175/106 |
| 4,512,422 | 4/1985 | Knisley . | |
| 4,667,751 | 5/1987 | Geczy et al. | 175/61 |
| 4,697,638 | 10/1987 | Knight . | |
| 4,739,842 | 4/1988 | Kruger et al. | 175/61 |
| 4,828,053 | 5/1989 | Maurer et al. | 175/75 |
| 5,139,094 | 8/1992 | Prevedel et al. . | |
| 5,188,190 | 2/1993 | Skaalure . | |
| 5,215,151 | 6/1993 | Smith et al. . | |
| 5,259,467 | 11/1993 | Schoeffler . | |
| 5,311,952 | 5/1994 | Eddison et al. . | |
| 5,339,913 | 8/1994 | Rives | 175/73 |
| 5,415,030 | 5/1995 | Jogi | 175/39 |
| 5,485,889 | 1/1996 | Gray | 175/61 |
| 5,535,835 | 7/1996 | Walker | 175/73 |
| 5,669,457 | 9/1997 | Sebastian et al. | 175/73 |
| 5,894,896 | 4/1999 | Smith et al. . | |

FOREIGN PATENT DOCUMENTS

| | | |
|---|---|---|
| 0 520 578 | 12/1992 | European Pat. Off. . |
| 2 026 063 | 1/1980 | United Kingdom . |
| 96/19635 | 6/1996 | WIPO . |

OTHER PUBLICATIONS

Technology Update: "Coiled Tubing BHA Orienter for Directional and Horizontal Drilling", Winter 1995, Sperry–Sun Drilling Services.

Maurer Engineering Inc., "National Science Foundation Deep Earth Sampling System Phase I Final Report", Jun. 1990.

*Primary Examiner*—Hoang Dang

*Attorney, Agent, or Firm*—David L. Moseley; Wayne I. Kanak; Steven L. Christian

[57] ABSTRACT

A steerable directional drilling tool assembly includes a bent housing defining a bend angle and having a mud motor in its upper section and a drill bit below its lower section, an orienting tool rotatably coupled to such upper section and suspended on coiled tubing that extends upward to the surface, an electric motor in the orienting tool operable to rotate the bent housing in either hand direction to change or adjust the tool face angle of the bit, or continuously rotate the bent housing so that the bit drills straight-ahead, and an electric cable extending throughout the coiled tubing to furnish power from the surface to the electric motor and transmit electric signals to and from the surface. A logging tool can be included in the assembly for measuring characteristics of the formation, the borehole, and the tool assembly.

23 Claims, 5 Drawing Sheets

APPARATUS AND METHOD FOR DIRECTIONAL DRILLING USING COILED TUBING

CROSS-REFERENCE TO RELATED APPLICATION

This application claims priority from provisional application 60/011,268 filed Feb. 7, 1996, which is incorporated herein by reference.

BACKGROUND OF THE INVENTION

1. Field of the Invention

This invention relates generally to a directional drilling system run on coiled tubing, and particularly to a system where the bent housing of the drilling motor is oriented by an associated electric motor relative to the coiled tubing in a manner such that the trajectory of the borehole is steered.

2. Description of the Related Art

A directional or deviated borehole typically is drilled by using a downhole motor, a bent housing, and a bit that are suspended on drill pipe that extends upward to the surface. The drill pipe can be rotated at the surface to orient the bent housing in order to control the tool face angle and thus the azimuth at which the borehole is drilled. The motor is powered by pumping a weighted drilling mud down the drill string and through the motor, and the mud has sufficient hydrostatic pressure to prevent any hydrocarbons from entering the borehole and creating hazardous and dangerous conditions at the surface. However, it is believed that the high hydrostatic pressure tends to impede the progress of the drilling by holding the chips or particles of rock that are loosened by the bit down on the bottom of the borehole so that the cleaning action of the mud as it emanates from the bit nozzles is not as efficient as desired.

A work string that can be run into a wellbore that is under pressure is coiled tubing, which is a long, jointless metal conduit that is wound on a large diameter reel at the surface. The reel, pumps and guides are mounted on a mobile surface unit, and an injector is used to drive the tubing into and out of the well under pressure through blowout preventers. Although this type of tubing has been used extensively for workover operations such as sand clean out, it cannot be rotated at the surface to achieve directional steering of a drilling motor and bent housing. However, this system is well suited for balanced or slightly underbalanced drilling to reduce or eliminate chip hold-down, and thereby permit a faster rate of penetration of the bit.

Another desirable feature in directional drilling with a downhole motor and bent housing is the ability to rotate the housing continuously so that its bend point merely orbits around the borehole axis so that the bit can drill straight ahead, rather than along a curved path. The ability to drill both curved and straight borehole sections enhances the drilling toward a particular target in the earth. When the drilling tools are run on drill pipe, this is readily accomplished by superimposing rotation of the drill pipe over that of the motor output shaft. However, when the same system is run on coiled tubing, this cannot be done. The present invention is uniquely arranged with a downhole electric motor that is employed to orient the bent housing relative to the lower end of the coiled tubing to achieve a selected tool face angle, or to continuously rotate the bent housing when desired for straight ahead drilling. The electric orienting motor is powered by an electric cable that extends to the surface through the coiled tubing.

This same electric cable also can be used to telemeter numerous borehole, motor performance and formation characteristic measurements uphole. The drilling process can be automatically controlled from the surface, and the angular orientation of the bent housing set at any desired value.

An object of the present invention is to provide a new and improved directional drilling system that is run on coiled tubing and used to drill a well that is under pressure.

Another object of the present invention is to provide a new and improved directional drilling system of the type described which includes an electric motor to orient the bent housing to achieve a selected tool face during curved-hole drilling, or to continuously rotate the bent housing to achieve straight-ahead drilling.

Still another object of the present invention is to provide a new and improved directional drilling system of the type described which includes means for measuring and transmitting to the surface various borehole, formation and drilling tool properties and characteristics that are useful in evaluation and automatic control of the drilling.

SUMMARY OF THE INVENTION

These and other objects are attained in accordance with the concepts of the present invention through the provision of a directional drilling system adapted to be mounted on the lower end of coiled tubing and including an orienting tool having an upper housing, a drilling tool including a mud motor in a lower bent housing, and a drill bit rotatably mounted at the lower end of the bent housing. An electric motor, preferably a brushless DC motor, is located in the orienting tool housing and is coupled to the lower housing by a gear train by which the bent housing can be oriented relative to the lower end of the coiled tubing at a desired angle by rotation in either direction relative thereto. The electric motor is powered by current that is fed to it by an armored electrical cable which extends up inside the coiled tubing to the surface where it extends to the inner end of the coiled tubing, which is wound on a reel, and where its conductors are connected by cummulator rings and brushes to a suitable junction and to a computer.

The drilling motor is powered by mud flow down the coiled tubing, and is coupled to the drill bit by a universal joint and drive shaft combination. The bent housing has upper and lower sections that are joined together at a low angle which causes the bit to drill along a curved path at a gradually increasing inclination angle with respect to the vertical. The electric motor and gear train are used to rotationally orient the bent housing and thereby control the tool face and azimuth of the curving borehole. If it is desired to drill straight ahead at whatever azimuth and inclination have been established, the electric motor and gear train can be operated to cause the bent housing to continuously rotate in either direction. Power circuits and a circulation value can be included in the orienting tool.

A logging tool can be fixed to the upper end of the orienting tool and provide measurements such as magnetic anomalies, gamma-ray, direction, and absolute pressures which are telemetered uphole via the electric cable in the coiled tubing. The lower end of the coiled tubing is rigidly fixed to the upper end of the logging tool so that the angular orientation of the bent housing can be held during drilling. A portion of the weight of the coiled tubing is applied to the bit by operating the injector head to the bit as drilling progresses, and can be automatically controlled to optimize the rate of penetration of the bit.

BRIEF DESCRIPTION OF THE DRAWINGS

The present invention has the above as well as other objects, features and advantages which will become more clearly apparent in connection with the following detailed description of a preferred embodiment taken in conjunction with the appended drawings in which.

DESCRIPTION OF A PREFERRED EMBODIMENT

Figure 1:
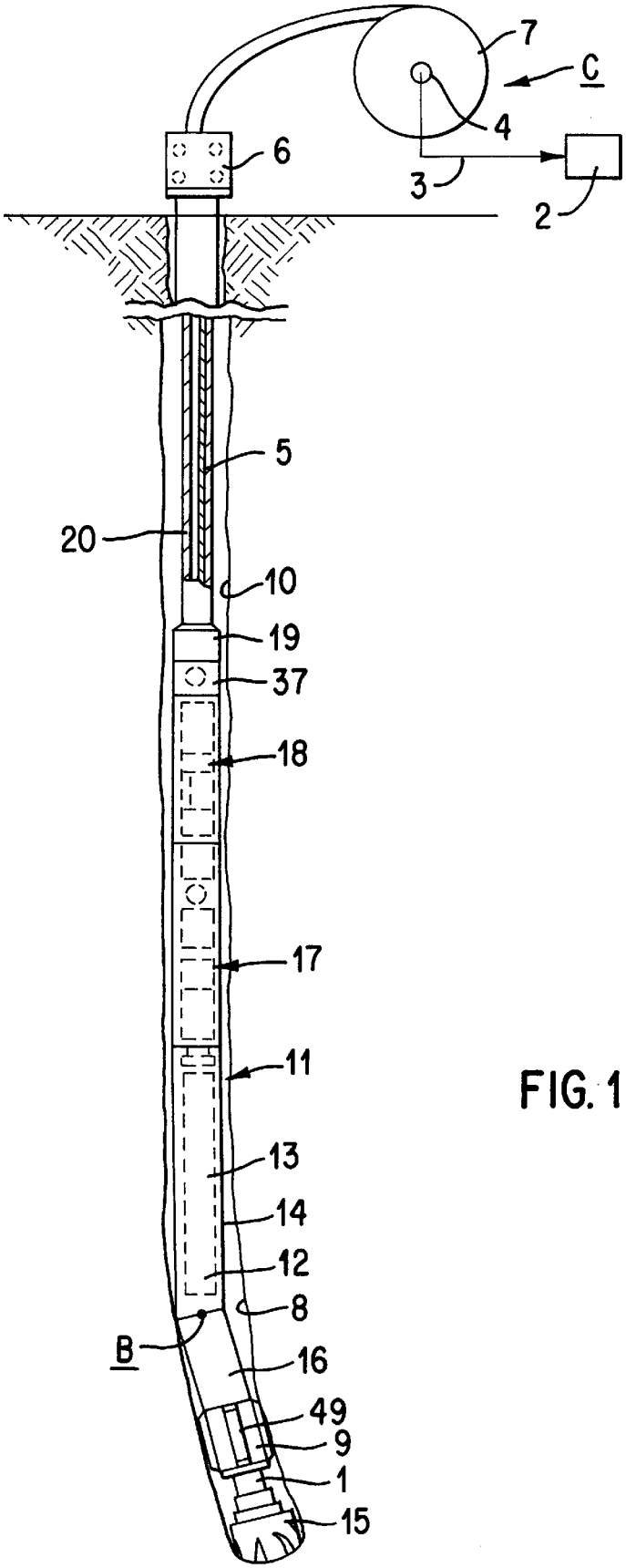
FIG. 1 is a schematic view showing the present invention being used to drill a directional wellbore.

Referring initially to FIG. 1, a curved section 8 of a borehole 10 is being drilled by an assembly 11 that includes a bent housing 12 having a mud motor 13 in its upper section 14 which drives a drill bit 15 that is mounted below its lower section 16. The drilling assembly 11 is connected to the lower end of an orienting tool 17 that can be operated to set or adjust the tool face angle of the bit 15, and the orienting tool 17 is attached to the lower end of a logging tool 18 having a head 19 at its upper end by which the components are suspended on the lower end of a string of coiled tubing 20 that extends upward to the surface. A coiled tubing unit C includes a reel 7 on which the coiled tubing 20 is wound after it emerges from an injector head 6 at the top of the well. An armored electrical cable or wireline 5 extends inside the coiled tubing 20 throughout its length, from the downhole assembly to a commutator 4 at the reel 7 where brushes connect the individual conductors to a cable 3 that leads to a data acquisition and sending unit 2.

The mud motor 13, which can be a positive displacement Moineau-type device, includes a lobed rotor that turns within a lobed stator in response to the flow of drilling fluids under pressure down the coiled tubing 20. The lower end of the mud motor 13 is connected to the bit 15 by a combination of drive shafts and universal joints. The central axes of the bent housing sections 14, 16 cross at bend point B at a low angle so that the bit 15 is influenced to drill the curved section 8 of the borehole 10 as shown.

Figure 2A:
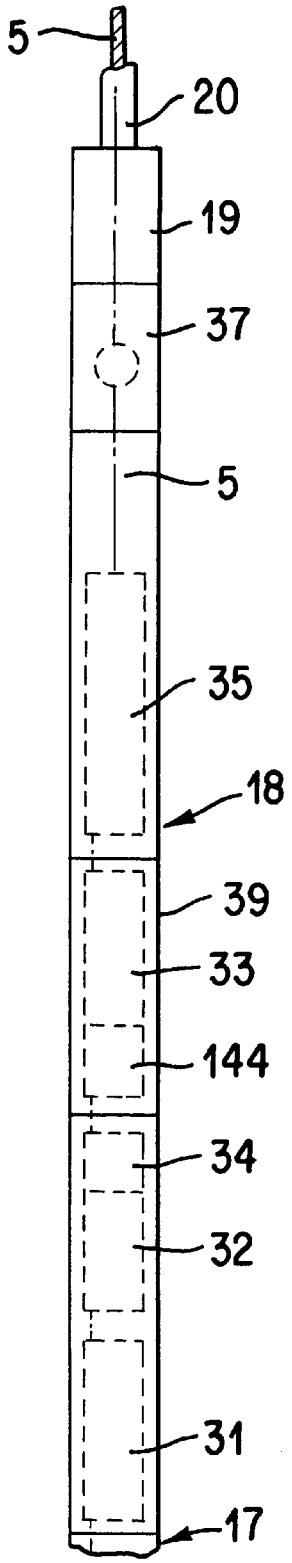
FIGS. 2A and 2B are enlarged, schematic views of the downhole tool assembly of FIG. 1.
Figure 2B:
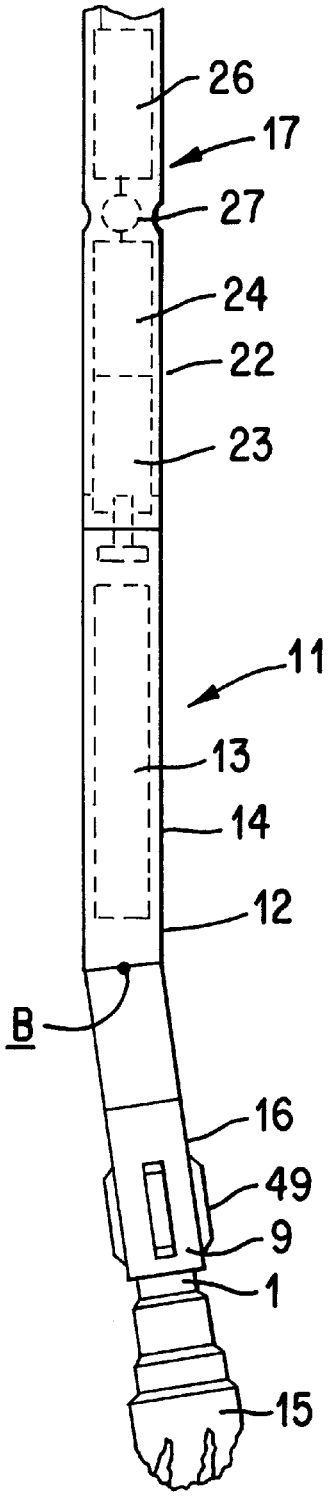

As illustrated in further detail in FIG. 2B, the bent housing 12 is oriented in the curved section 8 of the borehole 10 in order to obtain a selected tool face by the orienting tool 17 which includes a tubular housing 22 that is connected to the upper end of the bent housing 12 by components of a gear train indicated generally at 23. The orienting tool 17, as will be described in further detail below, has two principal functions 1) to rotate and then hold the bent housing 12 at a selected orientation with respect to the lower end of the coiled tubing 20 to control the azimuth of the borehole 10, and 2) to selectively rotate the drilling assembly 11 continuously in either direction to effect straight ahead drilling when desired. The gear train 23 is driven by an electric motor 24 that is mounted in the housing 22 and powered by current from the electrical cable 5 that extends up to the surface through the coiled tubing 20. Various electrical circuits 26 are used to supply power to the electric motor 24, and a normally closed circulating valve 27 having a suitable electrically controlled actuator can be opened to bypass mud flow out through ports in the housing 22.

The logging tool 18 is rigidly attached to the upper end of the orienting tool 17 and includes sensors for use in making various measurements during drilling. For example, a magnetometer 31 whose sensitive axis is oriented in line with the axis of the borehole 10 can be used to indicate magnetic anomalies caused by casing joints to provide accurate depth positioning in casing. A package of directional sensors 32 that includes three orthogonal magnetometers and three orthogonal accelometers measures inclination and the azimuth of that inclination, and the output signals also can be used to determine tool face angle. A set of pressure sensors 33 measure absolute internal and external pressures, and allow differential pressure to be calculated as an indication of the torque that is applied to the bit 15 by the mud motor 13. The internal pressure sensor also measures the frequency of the pressure pulses generated by the mud motor 13 and allows the rotation speed of the motor 13 to be calculated. A sensor 34 which detects the natural gamma ray emission of the earth formations can be located adjacent the directional sensor package 32, and take the form of a sodium iodide detector that is optically coupled to a photomultiplier tube.

Other measurements that can be made are formation resistivity using direct conduction or induction of current into the formations, porosity of the formations using nuclear magnetic resonance techniques, the acoustic velocity of sound waves through the rock using hydrophones to detect arrivals from natural structures ahead of the bit, and the weight-on-bit using a linear voltage differential transformer to measure axial deformation of the housing 39 of the logging tool 18.

A signal processing unit 35 receives the output signals from the various measuring devices and conditions them for transmission to the surface via the conductors in the armored electrical cable 5. An electrical disconnect mechanism 37 is provided to allow disconnection of the coiled tubing 20 from the downhole assembly in the event an emergency release is needed. The disconnect mechanism 37 is controlled from the surface via the electrical cable 5. In addition, the head 19 on the upper end of the housing 39 attaches to the coiled tubing 20 and to the cable 5. The head 19 includes two check valves and a quick coupling to connect both the electrical cable 5 and the coiled tubing 20 to the logging tool 18 and the orienting tool 17.

Referring now to FIGS. 3A–3D for structural details of the orienting tool 17, an elongated, tubular pressure housing 45 is centered within the outer tubular housing or collar 22 and is laterally spaced therefrom to provide an annular mud flow passageway 47. Circuit board modules 48 (only one shown for purposes of clarity) that are mounted in the pressure housing 45 provide power electronics for various electrically operated components, and preferably are arranged in a chamber 50 which contains air at atmospheric or other low pressure. Flexible joints 46 are used to support the circuit board modules 48 axially. The circulating valve 27 shown in phantom lines is mounted at the upper end of the pressure housing 45 and is electrically controlled. A sleeve valve S is rotated between closed and open positions with respect to the housing ports 39.

Figure 3A:
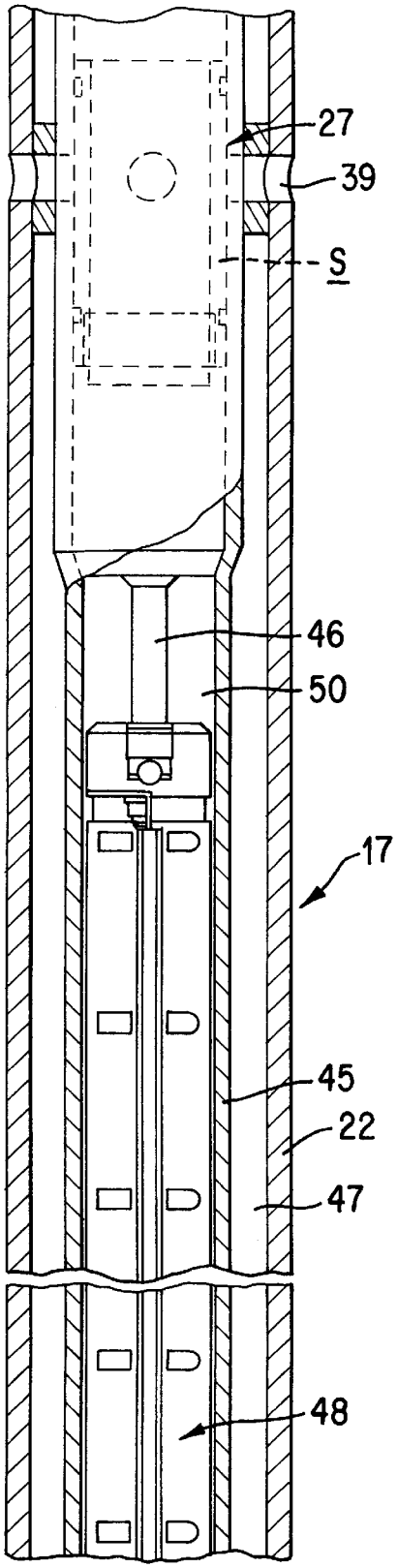
FIGS. 3A–3D are longitudinal sectional views of the orienting tool shown in FIG. 2B.
Figure 3B:
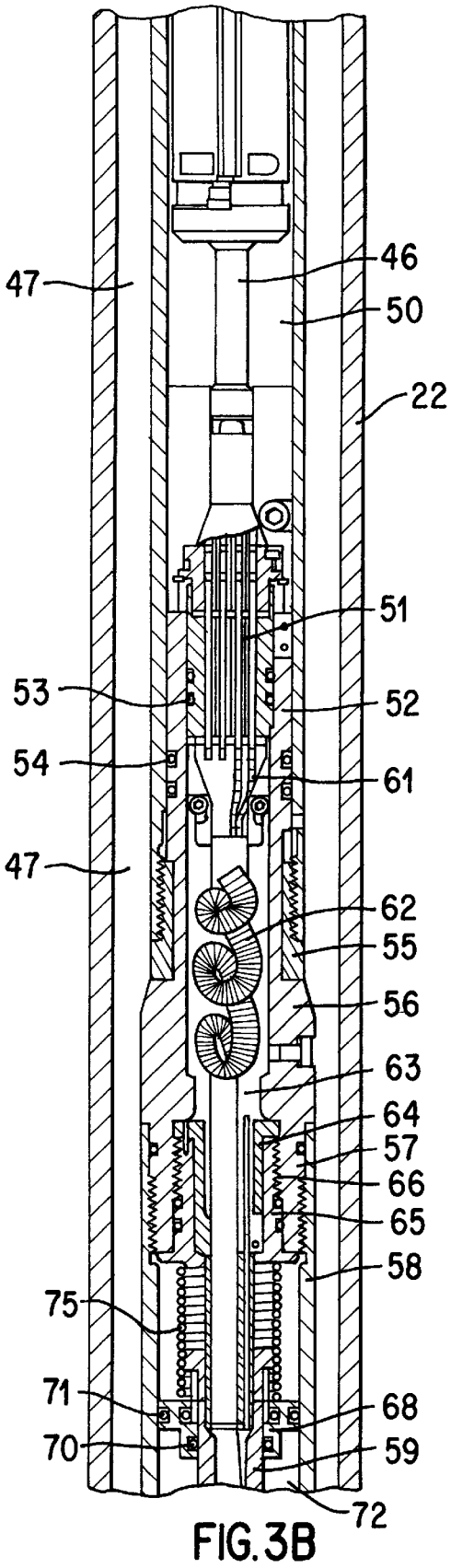
Figure 3C:
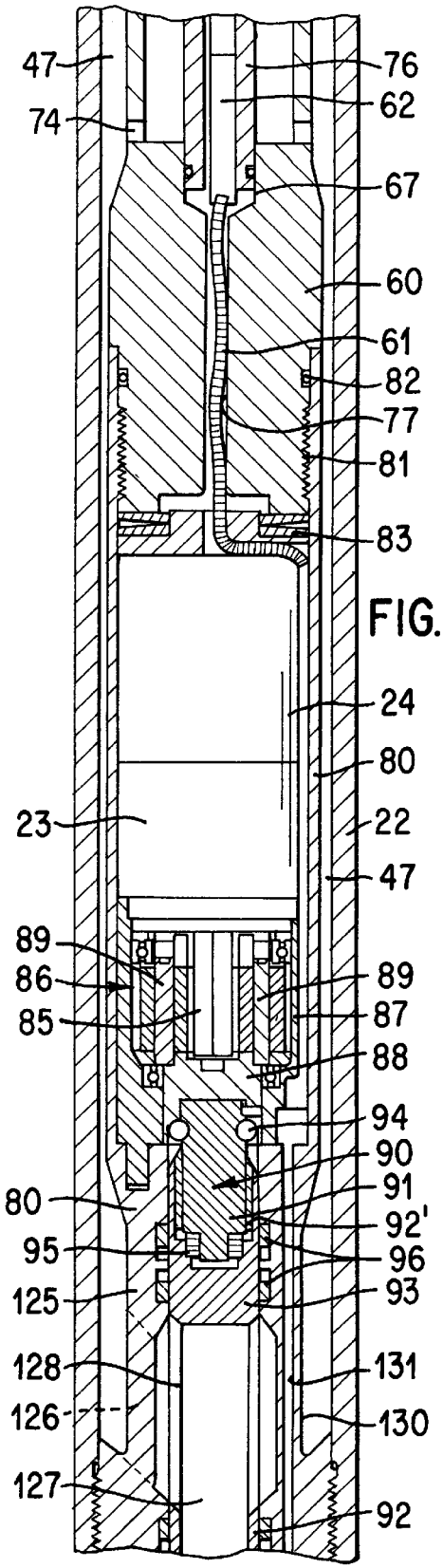

The lower end of the chamber 50 is closed by a high pressure feed-through connector 51 (FIG. 3B) that seats in a sleeve member 52. Seals such as o-rings 53, 54 prevent drilling mud from leaking into the chamber 50. A cap 55 is threaded into the lower end of the pressure housing 45, and the sleeve member 52 has an enlarged diameter portion 56 that engages the lower end of the cap 55. The lower end portion 57 of the sleeve member 52 is threaded into the upper end of a tube 58 that extends upward from a head 60 (FIG. 3C). The conductor wires 61 coming from the connector 51 can be gathered in a loom 62 which extends downward in an oil-filled chamber 63 inside the sleeve member 52. A bushing 64 is retained by a guide sleeve 65 that is threaded into the sleeve member 52 at 66. The lower portion 59 of the guide sleeve 65 is reduced in diameter and extends down to where its lower end seats in a bore 67 in the head 60. A compensating piston 68 (FIG. 3B) having inner and outer seals 70, 71 slides in the annular chamber 72 between the tube 58 and the lower portion 59 of the guide sleeve 65, and has its lower face subjected to mud pressure in the mud flow passageway 47 by radial ports 74. A coil spring 75 reacts between the upper portion of the guide sleeve 65 and the upper face of the compensating piston 68 and biases the piston 68 downward. All open spaces in the chamber 63 from the piston 68 to the connector 51 are filled with a suitable non-conductive hydraulic oil.

The conductor wire loom 62 extends down through the guide sleeve portion 76, and a bundle of the wires 61 passes through a central bore 77 in the head 60 to the electric motor 24 which preferably is a brushless DC type device. The electric motor 24 is mounted inside a tubular housing 80 whose upper end is threaded to the head 60 at 81 and sealed thereto by a seal ring 82. Resilient means such as disc springs 83 cushion the electric motor 24 against upward movement. The outer surface of the housing 80 is spaced from the inner surface of the outer housing 22 to continue the mud flow passageway 47.

The output shaft 85 of the electric motor 24 is coupled to an upper set of planetary gears 86 which mesh with a fixed outer ring gear 87. The shafts 89 of the planetary gears 86 revolve therewith around the output shaft 85 and thereby drive a coupling member 88 that is connected to a universal joint 90 on the upper end portion of a hollow drive shaft 92. The universal joint 90 includes a plug 91 that is coupled by splines 92' to the upper shaft portion 93, and to the coupling member 88 by balls 94 that seat in opposed recesses in the plug 91 and the coupling member 88. A plurality of disc springs 95 bias the plug 91 upward. Seals 96 prevent fluid leakage between the upper shaft portion 93 and the housing 80. A lower portion 96 (FIG. 3D) of the shaft 92 has a plurality of axial teeth or splines 97 that drive lower planetary gears 98 which mesh with a fixed ring gear 99 on the inside of an outer housing member 100 whose lower end is threaded to a housing sub 101 at 101'. The housing sub 101 is threaded to a bearing housing 102 at 103, the bearing housing 102 having an inwardly directed annular shoulder 104. A mandrel 105 having a threaded pin 106 extends up inside the bearing housing 102 and is sealed with respect thereto by seal elements 104'. A thrust bearing assembly 108 reacts between the shoulder 104 and a shoulder 107 formed by a reduced diameter section 106 of the mandrel 105. Additional thrust bearings 110 engage between the shoulder 104 and a stop sleeve 111 that is threaded to the mandrel 105 at 112. The upper end of the mandrel 105 is connected to a coupler 114 by a universal joint 113 that includes balls 115 which engage in opposed recesses in the mandrel 105 and the coupler 114. The coupler 114 is rotated by the shafts 116 of the planetary gears 98 as they revolve relative to the drive shaft 92. The coupler 114 is mounted in the outer housing member 100 by a roller bearing 117, and is retained by a spring-loaded sleeve piston 118 that pushes upward on a ring 120. The coupler 114 is further stabilized by disc springs 121 and a guide ring 122.

Figure 3D:
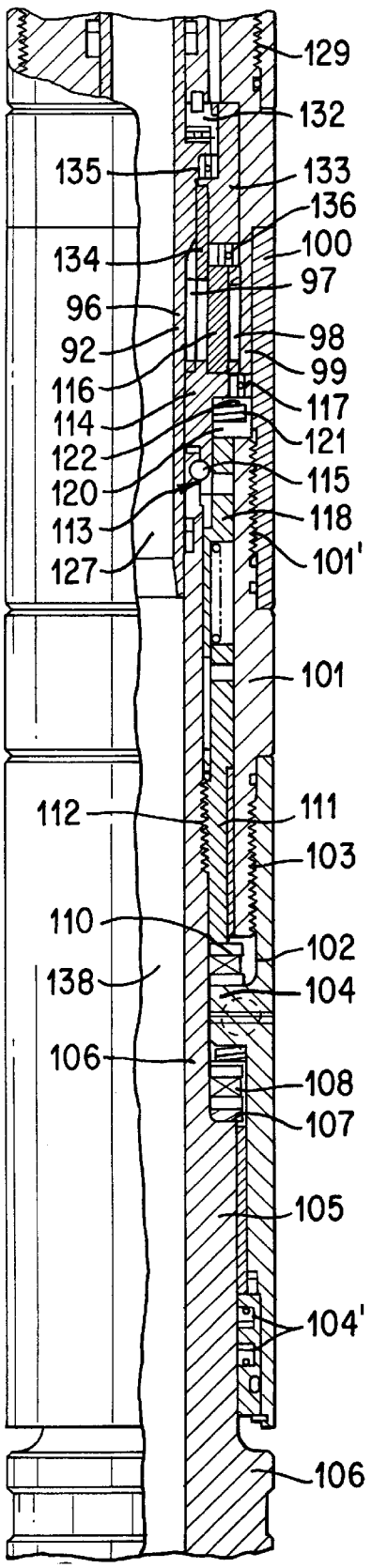

As shown in FIG. 3C, the lower section 125 of the housing 80 is formed with several large area flow ports 126 that communicate the mud flow passageway 47 with the bore 127 of the drive shaft 92 via flow slots 128 through the walls of the shaft. One of the solid regions 130 between the ports 126 is provided with an axial bore 131 which houses conductor wires that lead to an angular position sensor 132 (FIG. 3D). The angular position sensor 132 detects the angular orientation of the drive shaft 92 relative to the outer housing 22 and provides this measurement to the circuit board modules 48 for eventual transmission to the surface. The angular position sensor 132 is arranged inside a sleeve 133 which is threaded to a retainer 134 which mounts on the upper ends of the planetary gear shafts 116. Roller bearings 135 and 136 provide smooth rotation of parts. Drilling mud passing downward into the bore 127 of the hollow drive shaft 92 continues to flow down through the bore 138 of the mandrel 105 and into the top of the mud motor 13 which is rigidly attached by threads to the pin 106. Thus rotation of the mandrel 105 relative to the bearing housing 102 changes the angle of orientation of the bent housing 12 relative thereto.

The structure of the mud motor 13 is well known. The mud motor 13 is positioned inside the upper section 14 of the bent housing 12 that provides the bend angle with the lower section 16 thereof. The mud motor 13, as described generally above, drives the drill bit 15 via universal joints and shafts that connect its rotor to the mandrel 1 which extends up inside a bearing housing 9. Stabilizers 49 (FIG. 1) can be mounted on the bearing housing 9 and have a selected gauge.

OPERATION

Figure 4:
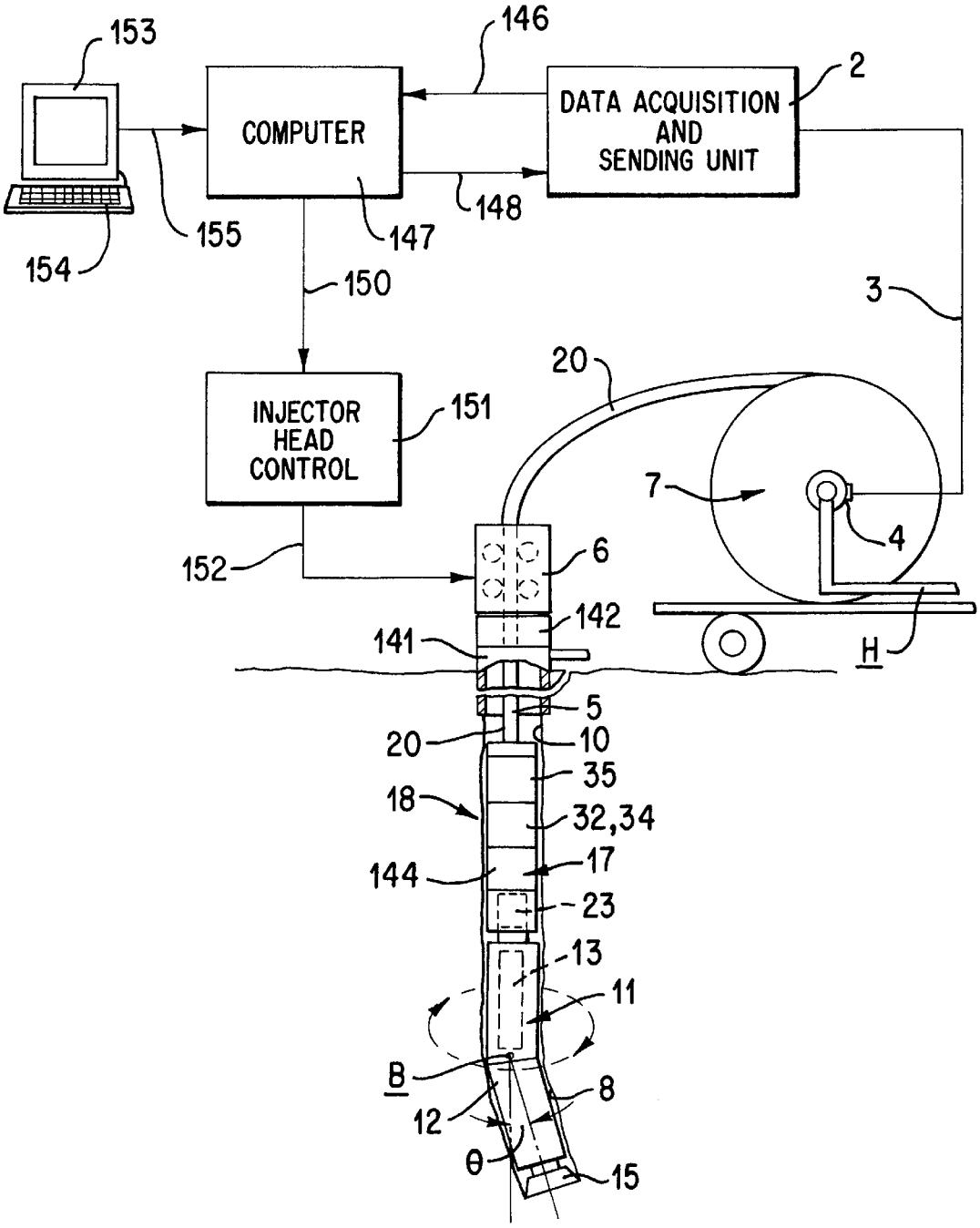
FIG. 4 is a schematic view of the downhole and surface components of the present invention.

The overall operation and use of the present invention is best understood with reference to FIG. 4. The reel 7 on which the coiled tubing 20 is stored is mounted on a truck that can be backed up into a position adjacent the wellhead 141. Guides (not shown) feed the coiled tubing 20 into an injector head 6 that is mounted on top of blowout preventers 142 which are bolted to the wellhead 141. The coiled tubing 20 is continuous throughout its length, and the electrical cable or wireline 5 disposed therein extends to the innermost end of the coiled tubing 20 where it is connected to a commutator 4 having a plurality of brushes that engage its rings as the reel 7 is rotated to pay out or reel in the coiled tubing 20. The brushes are connected to individual conductor wires in a cable 3 that extends to a data acquisition and sending unit 2. A conductor cable 146 out of the data acquisition and sending unit 2 is connected as an input to a computer 147, and another conductor cable 148 connects an output of the computer 147 to an input of the unit 2. Another output of the computer 147 is connected by a conductor cable 150 to an injector head control 151 having an output 152 that automatically controls the flow rate of the hydraulic motors that operate the tracks of the injector head 6. A monitor 153 and a keyboard 154 are connected at 155 to the computer 147 so that commands can be keyed in based upon data that are displayed on the monitor 153.

The lower end of the coiled tubing 20 suspends the downhole tool assembly including the logging tool 18, the orienting tool 17 and the mud motor 13. Drilling fluids pumped down the coiled tubing 20 through the hose H enter the mud motor 13 and cause it to drive the bit 15. As shown in FIG. 2A, the conductors in the armored electrical cable 5 extend to the signal processing unit 35, and from there various conductor wires extend to the pressure sensors 33, the gamma ray and directional sensors 34, 32, and to the magnetometer 31. Another sensor that may be included is a weight-on-bit (WOB) sensor 144. Conductors from the cable 5 also are coupled to the electrical circuits 26 which control the electric motor 24. The remote controlled circulating valve 27 having an electro-mechanical actuator can be opened and closed remotely from the surface as desired.

The orienting tool 17 is rotatably coupled to the bent housing 12 of the mud motor 13, so that momentary operation of the electric motor 24 can rotate the bent housing 12 relative to the orienting tool 17 and lower end of the coiled tubing 20 through any discrete angle in order to set, change or correct the tool face of the bit 15. The angular position sensor 132 measures such angle, which is referenced to the values measured by the directional sensor package 32. The electric motor 24 also can be operated to continuously rotate the bent housing 12 in either hand direction to achieve straight-ahead drilling rather than curved drilling. The rate of rotation of the bent housing 12 preferably is quite low, for example 1 rpm with 1000 ft/lbs. of torque being applied to the bit 15.

The downhole assembly including the mud motor 13, the orienting tool 17 and the logging tool 18 is run into the borehole 10 under pressure by using the injector head 6 to force the coiled tubing 20 downward. The bottom hole pressure of the mud column can be adjusted to be substantially balanced with respect to formation fluid pressure, or slightly underbalanced. When the mud motor 13 is just off bottom, the tool string is halted and the mud pumps started to circulate drilling fluids down the coiled tubing 20, through the mud motor 13, out of jets on the bit 15, and back to the surface through the annulus. With the mud motor 13 operating to turn the bit 15, the coiled tubing 20 is fed further downward by the injector head 6 to engage the bit 15 with the bottom of the borehole 10 and to impose a selected weight thereon as measured by the WOB sensor 144. The electric motor 24 and its gear train 23 are operated momentarily to achieve a selected angular orientation of the bent housing 12 and tool face angle of the bit 15 so that the curved section 8 of the borehole 10 is drilled at a selected azimuth.

The output of the electric motor 24 is delivered through the gear train 23 to the output shaft 85 at a significantly reduced rotational speed. This rotational speed is further reduced by the planetary gears 88 (FIG. 3C) which mesh with the fixed ring gear 87, and whose orbiting shafts 89 drive the coupling member 88 which is connected to the hollow drive shaft 92 by the universal joint 90. The drive shaft 92 drives the lower planetary gears 98 via spline teeth 97, and these gears 98 mesh with fixed ring gear 99 and thus orbit around the axis of the drive shaft 92. The shafts 116 of the planetary gears 98 drive the coupler 114 which is connected to the upper end of the mandrel 105 by the lower universal joint 113. Thus the bent housing 12, which is connected to the lower end of the mandrel 105, is turned very slowly compared to the speed of the electric motor 24. This feature allows fine adjustment or correction of the tool face angle by a momentary application of electrical power to the electric motor 24 via the cable 5 and the electrical circuits 26. The precise adjustment is measured by the angular position sensor 132 which measures the angle of rotation between the drive shaft 92 and the outer housing 22 which is threaded to the motor housing 80 at 129. This angle is referenced to the measurements of the directional sensor package 32 in the logging tool 18 and transmitted to the surface via the cable 5 where it can be viewed on the monitor 153 after processing by the computer 147.

Since the bent housing 12 provides a certain bend angle, usually in the range of from about 1 to 3 degrees, the bit 15 will drill along a curved path at the azimuth determined by its tool face. If corrections are needed as the curved section 8 of the borehole 10 is lengthened, the electric motor 24 again is operated in one direction or the other momentarily to adjust the angular orientation of the bent housing 12. If it is desired to drill straight ahead for some distance, a command signal is entered on keyboard 154 which causes power to be transmitted to the electrical circuits 26 so that the electric motor 24 rotates continuously. The gear train 23 causes the bent housing 12 to also rotate continuously, so that the bend point B orbits around the axis of the borehole. This causes the bit 15 to drill straight ahead at whatever inclination and azimuth have been established. Of course straight ahead drilling can be discontinued by stopping such rotation, and re-orienting the tool face.

The downhole WOB measurement from sensor 144 is used to control the operation of the injector head 6 to automatically maintain a constant WOB value, which controls the rate of penetration of the bit 15. The directional data from the directional sensor package 32 is processed by the computer 147 and displayed at the surface monitor 153, and the gamma ray measurements from the sensor 34 are logged in the usual manner. Signals from the pressure sensors 33 are processed to determine the torque that is being applied to the bit 15 by the mud motor 13, and magnetic anomalies are detected by the magnetometer 31 and transmitted to the surface for depth control. Other logging measurements such as resistivity, porosity, and acoustic properties of the formations also can be made, and electrical signals representative thereof transmitted to the surface via the armored electrical cable 5 where they are logged in the typical manner.

The circulating valve 27 above the mud motor 13 can be opened and closed in response to electrical signals to allow the circulation of drilling fluids to bypass the mud motor 13 and the bit 15. Thus the characteristics of the drilling fluids can be conditioned. In case of an emergency, the disconnect mechanism 37 can be operated electrically to disconnect the lower end of the coiled tubing 20 and the cable 5 from the downhole assembly. The disconnect mechanism 37 can also be used to re-connect both the electrical cable 5 and the coiled tubing 20 to the downhole assembly.

It now will be recognized that a new and improved directional drilling tool that is run on coiled tubing has been disclosed. The drilling can be performed with the well under pressure to maximize rate of penetration. The bent housing of the mud motor is oriented by a surface controlled electric motor to control the tool face angle as drilling proceeds along a curved path, or is rotated continuously to achieve straight-ahead drilling. Various measurements are telemetered uphole via the electric cable to allow automatic drilling under optimum conditions, and various logging measurements also can be made and transmitted uphole as the borehole is deepened. Since certain changes and modifications may be made in the disclosed embodiments without departing from the inventive concepts involved, it is the aim of the appended claims to cover all such changes and modifications falling within the true spirit and scope of the present invention.

What is claimed is:

1. A directional drilling assembly for use in drilling a curved or a straight borehole, comprising:

a bent housing having an upper section and a lower section; a bit mounted below said lower section thereof; a mud flow operated motor in said upper section for rotating said bit; a tubular housing coupled to said upper section of said bent housing for rotation relative thereto; and remote controlled means comprising an electric motor in said tubular housing for rotating said bent housing to an angular orientation relative thereto that provides a selected tool face angle for said bit.

2. The assembly of claim 1 wherein said electric motor has an output shaft and reduction gear means connecting to said output shaft for causing rotation of said bent housing.

3. The assembly of claim 2 further including means including a string of coiled tubing for suspending said drilling assembly in a borehole, and an electric cable in said coiled tubing for supplying power to said electric motor to remotely operate the same.

4. The assembly of claim 3 further including means for detecting the orientation angle of said bent housing relative to said tubular housing, and for transmitting a signal representative of said orientation angle to the surface via said cable.

5. The assembly of claim 3 further including a measurement tool connected between said tubular housing and the lower end of said coiled tubing, said measurement tool including sensor means for measuring one or more characteristics of the borehole, the formation surrounding said borehole, or the drilling assembly and for transmitting signals representative thereof to the surface via said cable.

6. The assembly of claim 1 wherein said remote controlled means is operable to rotate said bent housing in either rotational direction in order to adjust said tool face angle.

7. The assembly of claim 1 wherein said electric motor is a brushless DC motor.

8. The assembly of claim 3 wherein said electric motor is a brushless DC motor.

9. The assembly of claim 5 wherein said sensor means comprises pressure sensors for measuring absolute internal and external pressures.

10. A directional drilling tool string adapted to be suspended in a well on coiled tubing and used to drill a curved or a straight borehole, comprising: a bent housing having an upper section and a lower section connected at an angle; mud motor means in said upper section for driving a drill bit mounted below said lower section: orienting means coupled to said upper section and including electric motor means operable to momentarily rotate said bent housing relative to said orienting means to establish a selected tool face angle for said bit, said electric motor means also being operable to continuously rotate said bent housing to achieve straight-ahead drilling; means for connecting said orienting means to said coiled tubing; and electric cable means disposed in said coiled tubing for delivering electrical power to said electric motor means.

11. The tool string of claim 10 further including coupling means for rotatably connecting said upper section to said orienting means, said coupling means including planetary gear means for effecting a substantial reduction in the rotational output speed of said electric motor means.

12. The tool string of claim 11 wherein said planetary gear means includes upper and lower sets of planetary gears arranged to rotate around a driven center gear, each of said sets meshing with a fixed, outer ring gear, the shafts of said upper set driving an upper hollow shaft and the shafts of said lower set driving a lower hollow shaft, said lower shaft being connected to said upper section of said bent housing.

13. The tool string of claim 12 further including upper universal joint means for connecting said shafts of said upper planetary gear set to said upper hollow shaft, and lower universal joint means for connecting said shafts of said lower planetary gear set to said lower hollow shaft.

14. The tool string of claim 10 further including power circuit means in said orienting means for controlling the operation of said electric motor means, said power circuit means being connected to said electric cable means.

15. The tool string of claim 14 wherein said orienting means includes an outer tubular housing and an inner tubular housing said power circuit means and said electric motor means being mounted in said inner tubular housing, upper fluid passage means between said housings, and cross-over passage means between said upper fluid passage means and the bores of said upper and lower hollow shafts to enable drilling fluids pumped down said coiled tubing to enter said mud motor means via said upper fluid passage means, said cross-over passage means and said bores.

16. The tool string of claim 10 further including sensor means for detecting the angle of relative rotation between said orienting means and said upper section of said bent housing.

17. The tool string of claim 10 further including logging tool means for making measurements, said logging tool means being located between said orienting means and said coiled tubing, and means for transmitting said measurements to the surface via said electric cable means.

18. A method of steering a directional drilling tool string having a bent housing rotatable relative to an orienting tool, said orienting tool and bent housing being suspended in a borehole on coiled tubing, comprising the steps of: coupling said bent housing to an electric motor in said orienting tool; and operating said electric motor to change the orientation angle of said bent housing relative to said orienting tool while using said coiled tubing to prevent rotation of said orienting tool in the borehole.

19. The method of claim 18 including the further step of disposing an electric cable in said coiled tubing throughout the length thereof, and providing electric power from the surface to said electric motor via said cable.

20. The method of claim 19 including the step of operating said electric motor continuously to cause the bend point of said bent housing to orbit around the axis of the borehole so that a drill bit mounted below said bent housing drills straight ahead for so long as said rotation is continuous.

21. A directional drilling system for use in drilling a curved or a straight borehole, comprising:

means, including a string of coiled tubing, for suspending a drilling assembly in said borehole;

a drilling assembly suspended from said string of coiled tubing and comprising a bent housing having an upper section and a lower section;

a bit mounted below said lower section thereof;

a mud flow operated motor in said upper section for rotating said bit;

a tubular housing coupled to said upper section of said bent housing for rotation relative thereto;

remote controlled means in said tubular housing for rotating said bent housing to an angular orientation relative thereto that provides a selected tool face angle for said bit, said remote controlled means for rotating said bent housing comprising an electric motor having an output shaft and reduction gear means for coupling said output shaft and said bent housing; and an electric cable in said string of coiled tubing for supplying power to said electric motor to remotely operate said electric motor.

22. The system of claim 21 wherein said remote controlled means are also operable to rotate said bent housing continuously to achieve straight ahead drilling.

23. The system of claim 22 wherein said electric motor is a brushless DC motor and said reduction gear means comprises planetary gear means.

* * * * *